US007219460B1

(12) United States Patent
Grayson

(10) Patent No.: US 7,219,460 B1
(45) Date of Patent: May 22, 2007

(54) DOCUMENT DISPLAYING SYSTEM

(76) Inventor: Thomas Grayson, 510 N. Hampton St., Anaheim, CA (US) 92801

( * ) Notice: Subject to any disclaimer, the term of this patent is extended or adjusted under 35 U.S.C. 154(b) by 4 days.

(21) Appl. No.: 11/333,470

(22) Filed: Jan. 17, 2006

Related U.S. Application Data

(60) Continuation-in-part of application No. 11/043,888, filed on Jan. 26, 2005, now Pat. No. 7,152,354, which is a division of application No. 10/638,157, filed on Aug. 8, 2003, now Pat. No. 6,922,930.

(51) Int. Cl.
*A47G 1/06* (2006.01)

(52) U.S. Cl. ..... 40/711; 40/700

(58) Field of Classification Search ..... 40/711, 40/700

See application file for complete search history.

(56) References Cited

U.S. PATENT DOCUMENTS

| | | | | | |
|---|---|---|---|---|---|
| 2,785,490 | A * | 3/1957 | Fabry | 40/711 |
| 3,553,872 | A * | 1/1971 | Ebner | 40/711 |
| 3,553,873 | A * | 1/1971 | Weston | 40/711 |
| 3,952,435 | A * | 4/1976 | Olsen | 40/711 |
| 4,030,220 | A * | 6/1977 | Kotchen | 40/700 |
| 4,583,309 | A * | 4/1986 | Kane et al. | 40/711 |
| 4,785,562 | A * | 11/1988 | Good | 40/711 |
| 4,831,756 | A * | 5/1989 | Huang et al. | 40/711 |
| 5,075,991 | A | 12/1991 | Wenkman et al. | |
| 5,158,295 | A * | 10/1992 | Shilling | 273/157 R |
| 5,167,087 | A | 12/1992 | Plumly | |
| 5,195,263 | A | 3/1993 | Huang | |
| 5,303,489 | A | 4/1994 | Blegen | |
| 5,303,493 | A | 4/1994 | Plumly | |
| 5,309,659 | A | 5/1994 | Eastman | |
| 5,363,579 | A | 11/1994 | Plumly | |
| 6,052,933 | A | 4/2000 | Lytle | |
| 6,308,446 | B1 | 10/2001 | Healy | |
| 2003/0121193 | A1* | 7/2003 | Kim | 40/711 |

* cited by examiner

*Primary Examiner*—Gary C. Hoge

(57) ABSTRACT

A document displaying system for facilitating easy access to documents being displayed. The document displaying system includes a support assembly having a backing member selectively couplable to a vertical support surface; a frame assembly operationally couplable to the support assembly; a transparent cover member operationally couplable to the frame assembly, and abutting a perimeter edge of the transparent cover member; and a pair of magnetic coupling members for selectively operationally securing the transparent cover member to the support assembly.

9 Claims, 9 Drawing Sheets

DOCUMENT DISPLAYING SYSTEM

CROSS REFERENCE TO RELATED APPLICATION

This application is a continuation-in-part of U.S. patent application Ser. No. 11/043,888, filed Jan. 26, 2005, now U.S. Pat. No. 7,152,354, which in turn is a divisional of application Ser. No. 10/638,157, filed Aug. 8, 2003, now U.S. Pat. No. 6,922,930.

BACKGROUND OF THE INVENTION

1. Field of the Invention

The present invention relates to document displaying devices and more particularly pertains to a new document displaying system for facilitating easy changing of documents to be displayed.

2. Description of the Prior Art

The use of document displaying devices is known in the prior art. U.S. Pat. No. 5,303,493 describes a device for displaying advertising in a floor surface. Other examples of document displaying devices include U.S. Pat. No. 6,308,446; U.S. Pat. No. 5,309,659; U.S. Pat. No. 5,195,263; U.S. Pat. No. 5,167,087; U.S. Pat. No. 5,363,597; U.S. Pat. No. 6,052,933; U.S. Pat. No. 5,303,489; and U.S. Pat. No. 5,075,991.

While these devices fulfill their respective, particular objectives and requirements, the need remains for a system that provides for additional stability of a frame, support of the system's weight, and easy front access to the document being displayed.

SUMMARY OF THE INVENTION

The present invention meets the needs presented above by utilizing an intermediate member which is positionable in the frame assembly between the transparent cover member and the backing member to aid the frame in both retaining its shape and transferring at least a portion of the frame assemblies weight to the vertical support surface to which the system is coupled.

Another object of the present invention is to provide a new document displaying system that provides a coupling mechanism, which is hidden from view to reduce tampering with the document being displayed.

Still another object of the present invention is to provide a new document displaying system that has a groove along the back edge of the system adjacent to the vertical support surface to facilitate, for example, the painting of a vertical support surface on which the displaying system is mounted without requiring the removal of the displaying system from the vertical support surface to obtain a suitable appearance.

To this end, the present invention generally comprises a support assembly having a backing member selectively couplable to a vertical support surface; a frame assembly operationally coupled to the support assembly; a transparent cover member operationally couplable to the frame assembly, and abutting a perimeter edge of the transparent cover member; and a pair of magnetic coupling members for selectively operationally securing the transparent cover member to the support assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
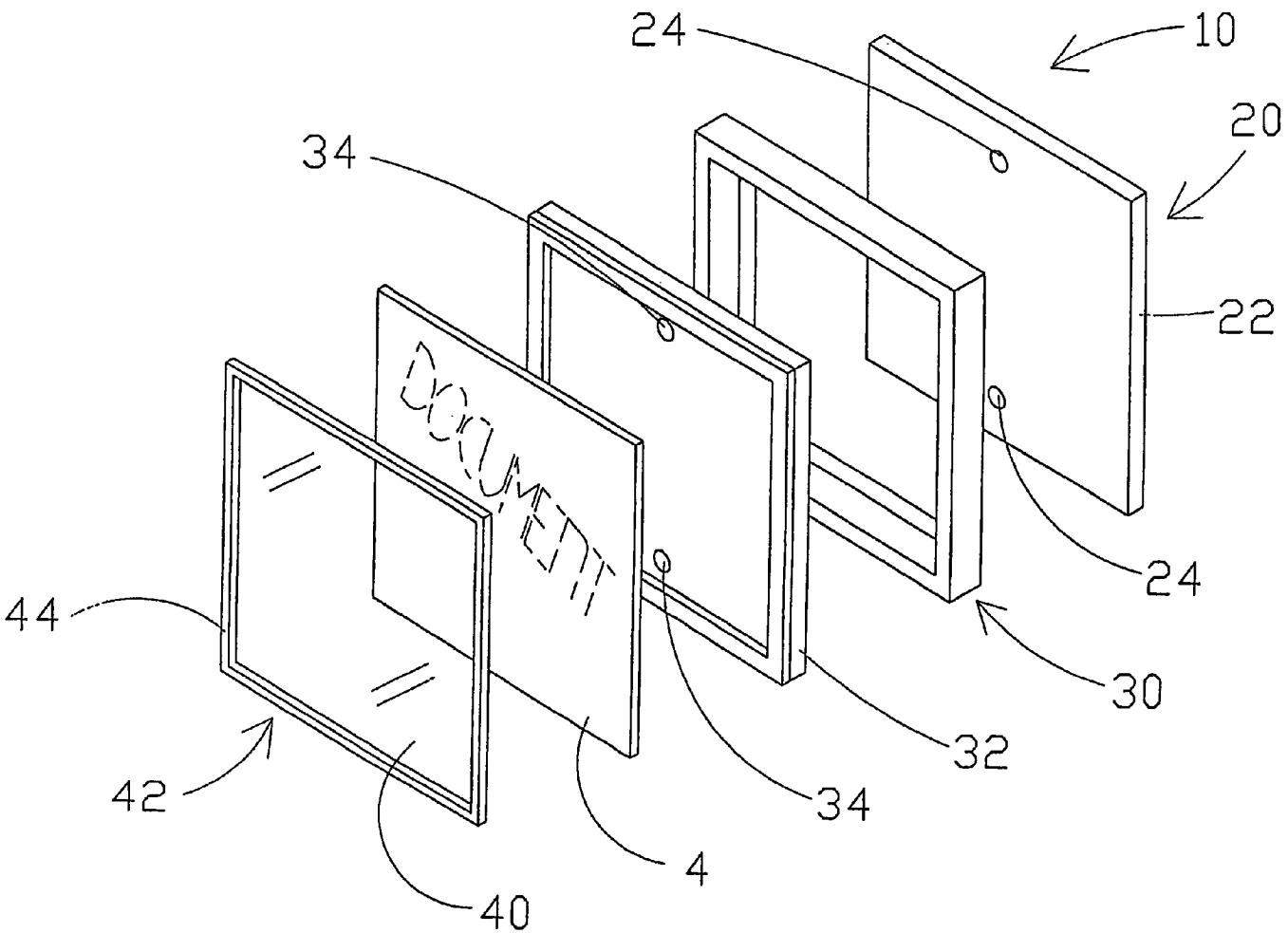
FIG. 1 is a schematic perspective exploded view of a new document displaying system according to the present invention.
Figure 2:
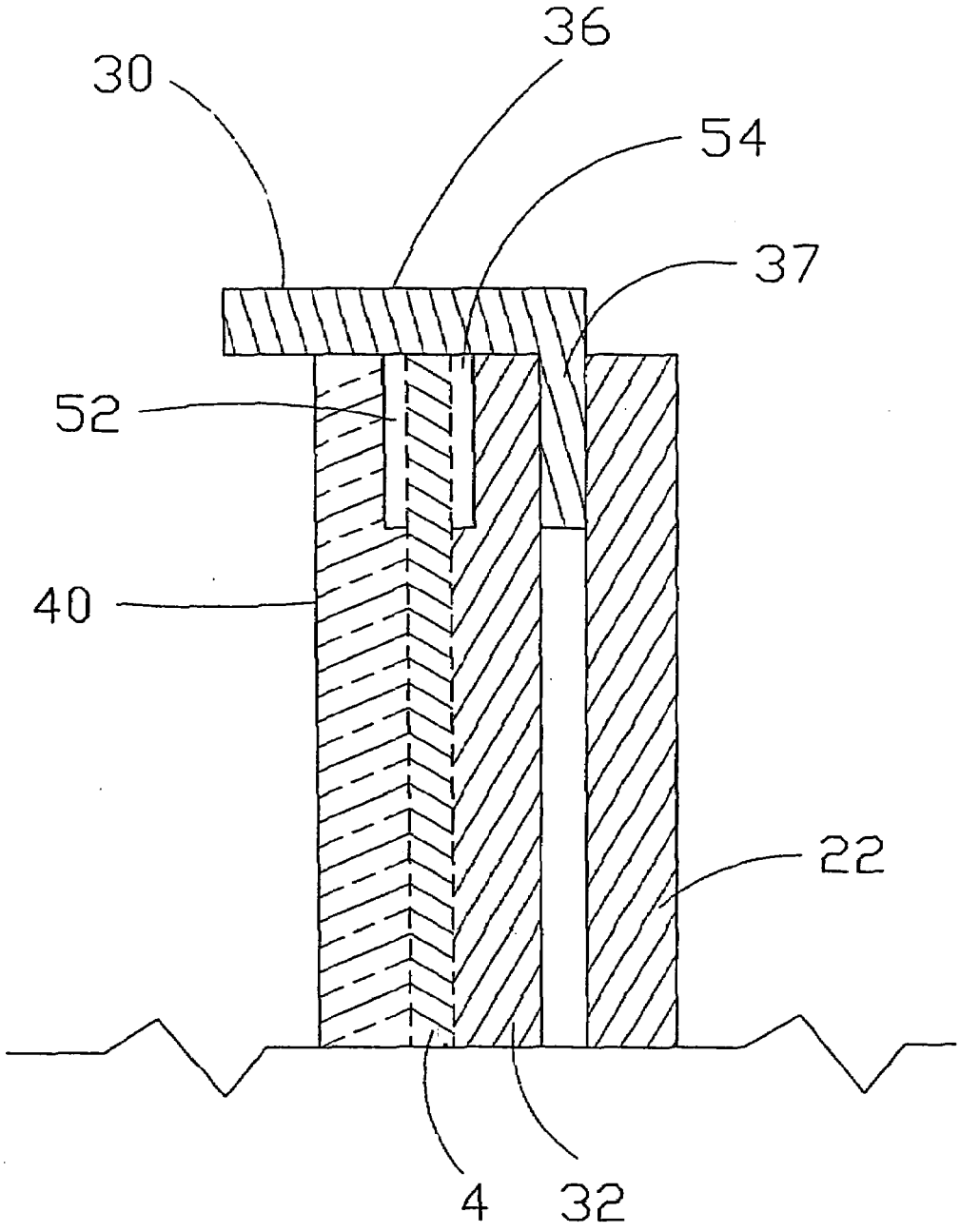
FIG. 2 is a schematic cross-sectional side view of the present invention.
Figure 3:
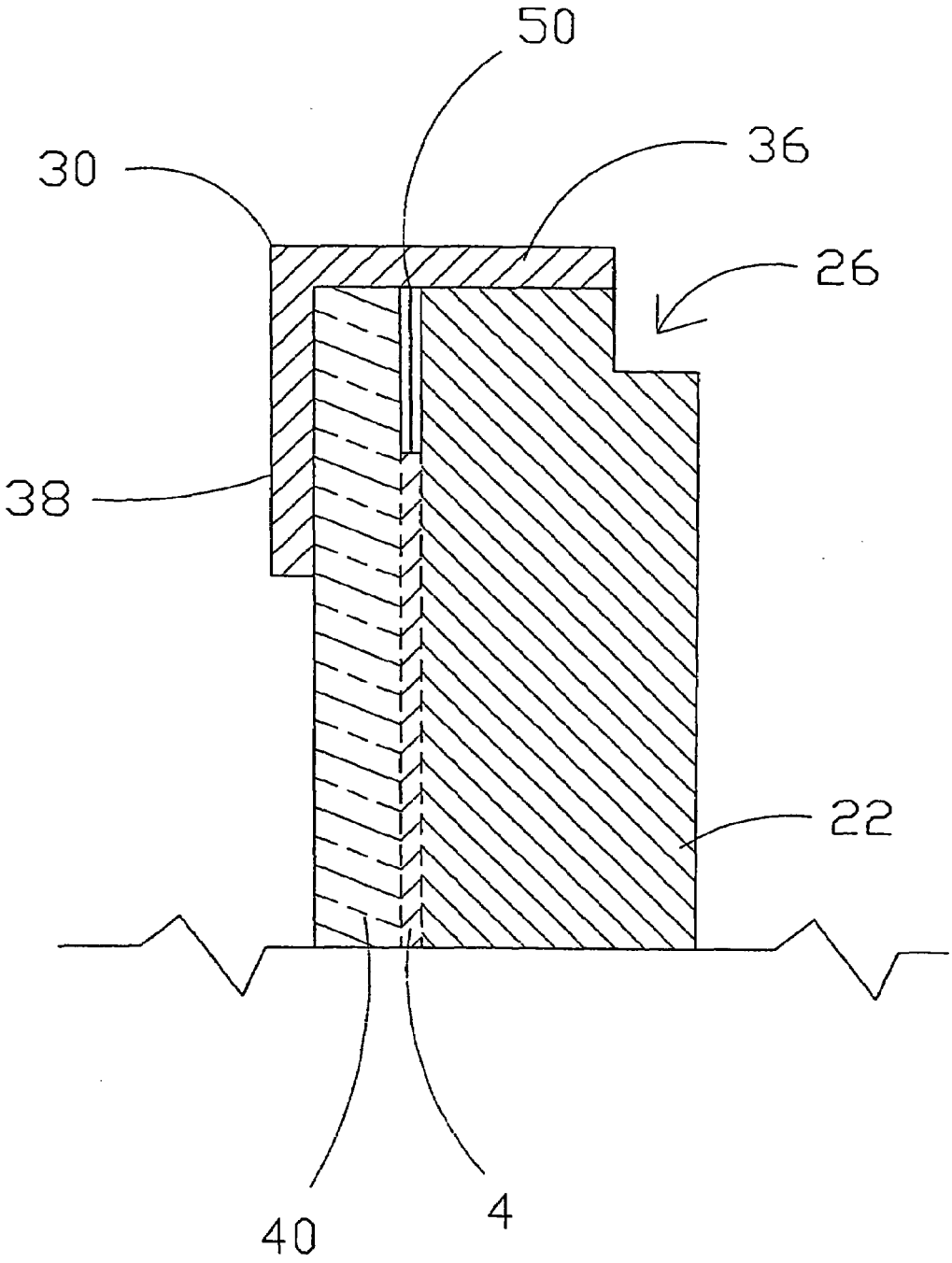
FIG. 3 is a schematic cross-sectional side view of an embodiment of the present invention.
Figure 4:
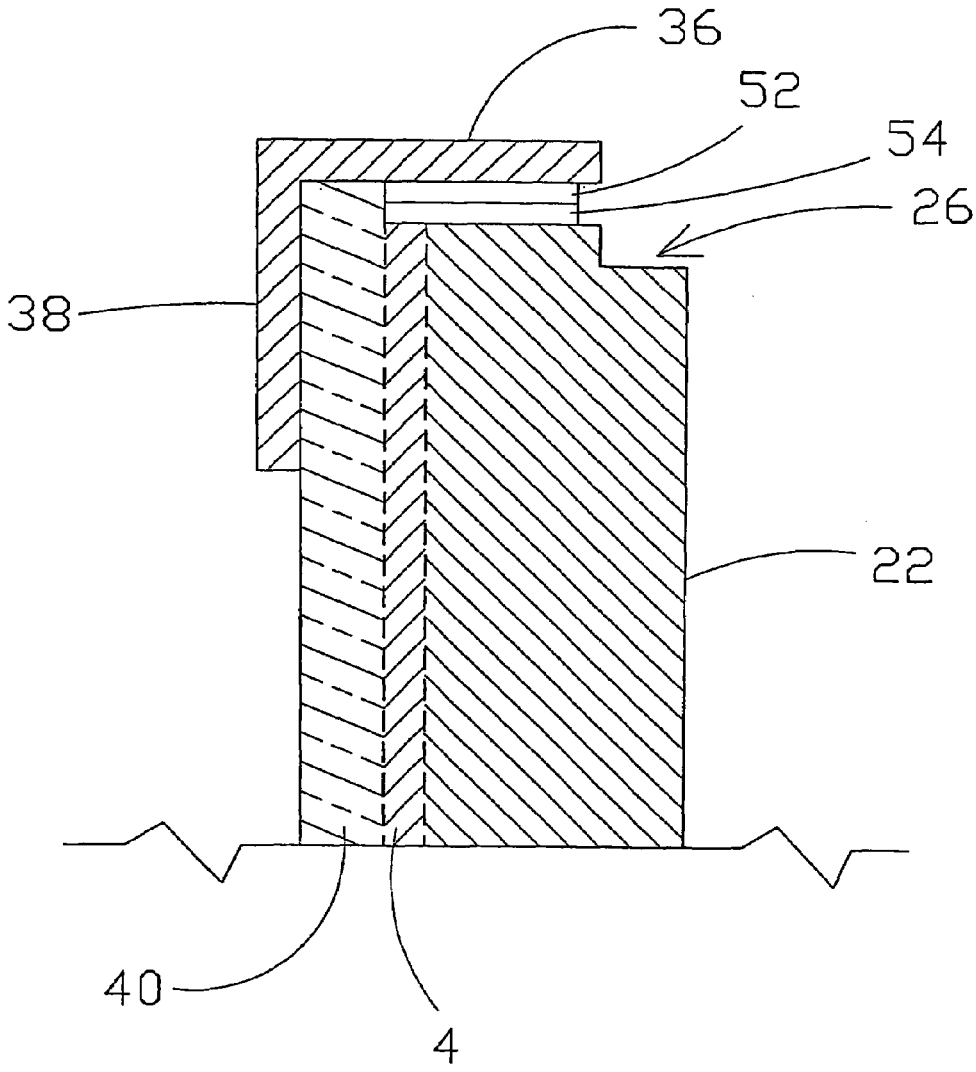
FIG. 4 is a schematic cross-sectional side view of an embodiment of the present invention.
Figure 5:
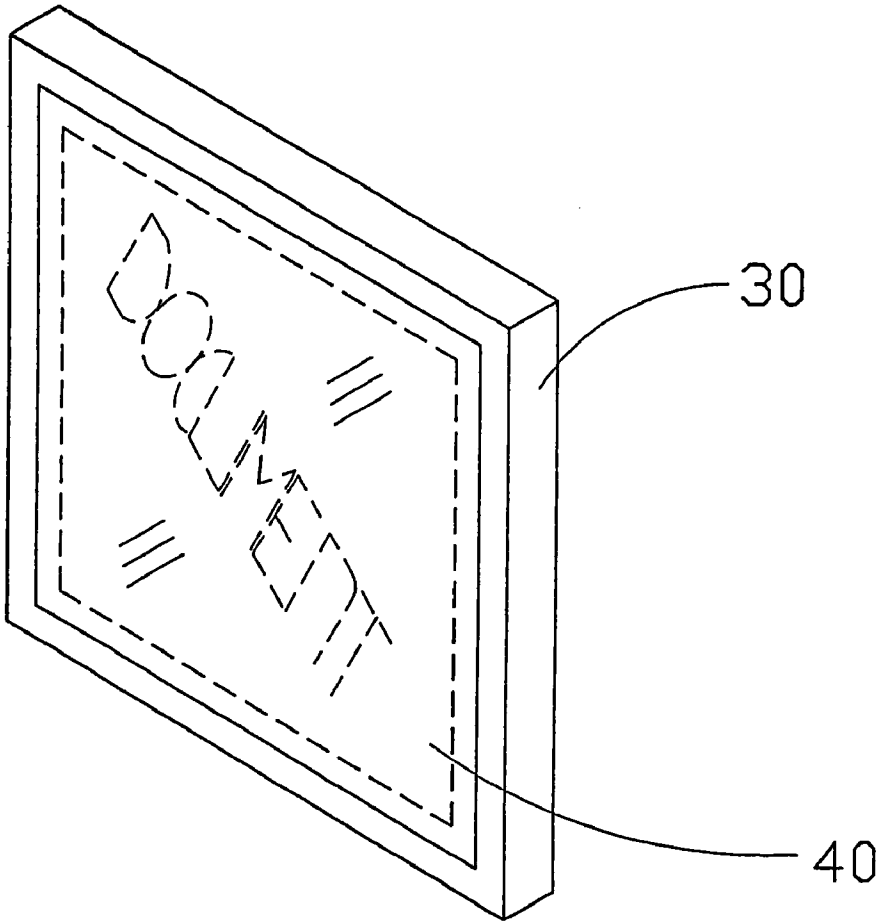
FIG. 5 is a schematic perspective view of the present invention.
Figure 6:
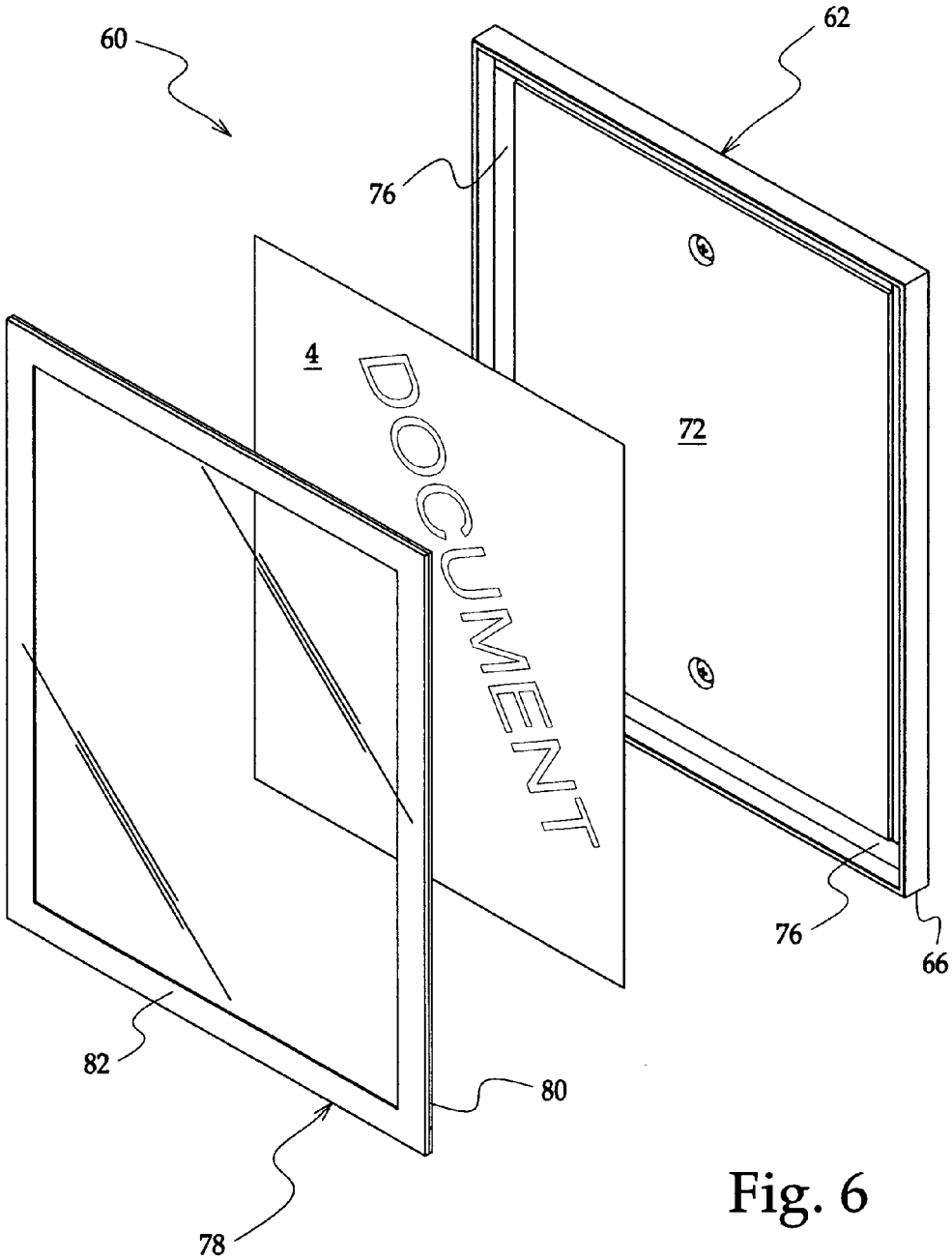
FIG. 6 is a schematic exploded perspective view of a variation of the new document displaying system of the present invention.
Figure 7:
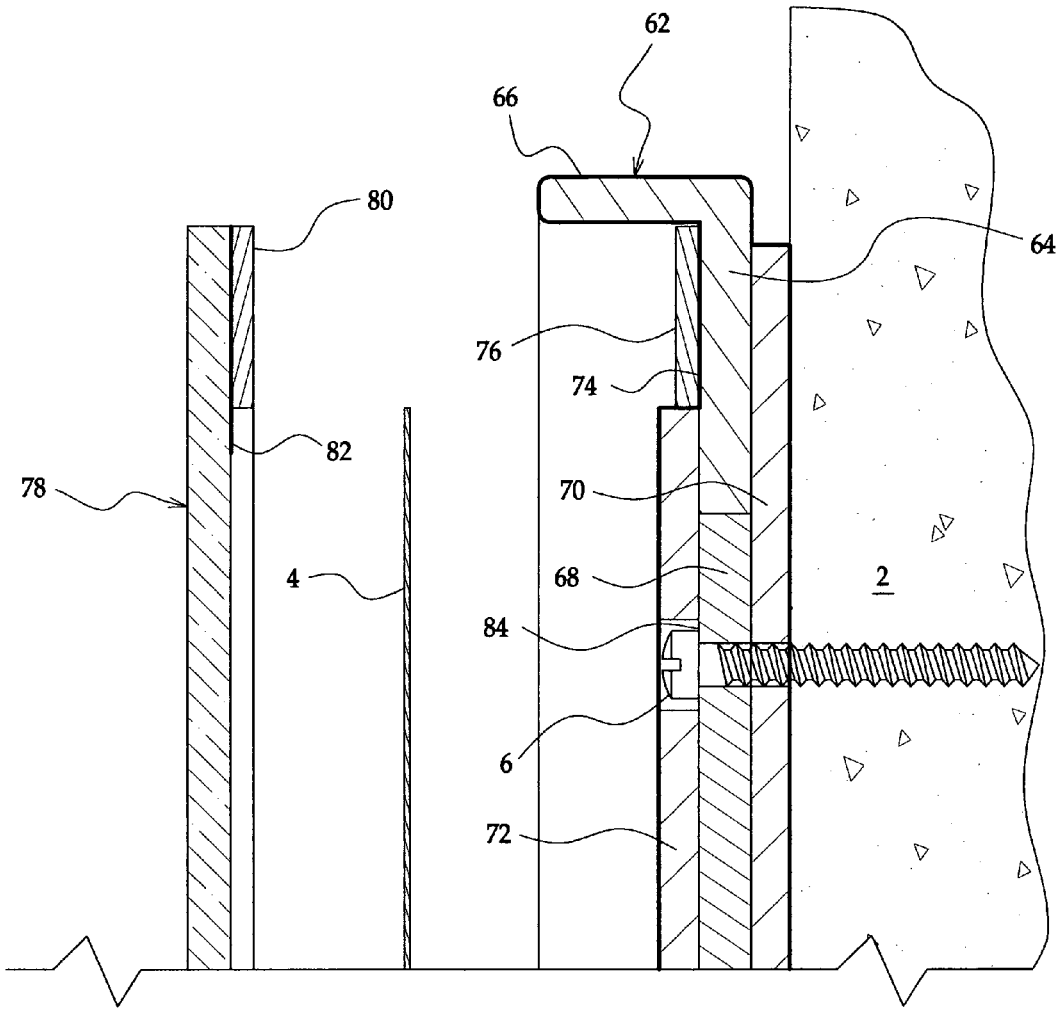
FIG. 7 is a schematic partially exploded cross-sectional view of a multi-piece version of the variation shown in FIG. 6 of the drawings.

With reference now to the drawings, and in particular to FIGS. 1 through 9 thereof, a new document displaying system embodying the principles and concepts of the present invention and generally designated by the reference numeral 10 will be described.

As best illustrated in FIGS. 1 through 5, the document displaying system 10 generally comprises a support assembly 20, a frame assembly 30, a transparent cover member 40, and a pair of magnetic coupling members 50.

The support assembly 20 includes a backing member 22 which is selectively couplable to a vertical support surface 2 such as a wall. The frame assembly 30 is operationally couplable to the support assembly 20. The transparent cover member 40 is operationally couplable to the frame assembly 30. The frame assembly 30 abuts a perimeter edge of the transparent cover member 42. The transparent cover member 40 is for protecting a document 4 to be displayed. The pair of magnetic coupling members 50 is for selectively operationally securing the transparent cover member 40 to the support assembly 20.

Preferably, an intermediate board member 32 is positionable in the frame assembly 30 between the support assembly 20 and the transparent cover member 40. The intermediate board member 32 provides support for the frame assembly 30 and aids the frame assembly 30 in retaining its shape.

In a preferred embodiment, at least one back mounting aperture 24 extends through the backing member 22 for facilitating securing the support assembly 20 to the vertical support surface 2. More preferably two back mounting apertures 24 are used to inhibit the system 10 from pivoting across the vertical support surface 2.

At least one intermediate mounting aperture 34 may extend through the intermediate board member 32. The intermediate mounting aperture(s) 34 is aligned with the back mounting aperture(s) 24 for facilitating securing the intermediate board member 32 to the vertical support surface 2. Thus, a portion of the weight of the frame assembly 30 is supported by the intermediate board member 32.

In an embodiment the transparent cover member 40 includes an opaque portion 44 extending around a perimeter edge 42 of the transparent cover member 40. The opaque portion 44 provides an appearance of a mat around the document being displayed. The opaque portion 44 may also conceal the magnetic coupling members 50 from view when the system 10 is fully assembled.

In a further embodiment the frame assembly 30 further comprises a side portion 36 and a back portion 37. The side portion 36 is for encompassing a perimeter edge 42 of the transparent cover member 40. The back portion 37 is coupled to the side portion 36. The back portion 37 is positionable between the backing member 22 and the transparent cover member 40.

In a preferred embodiment the frame assembly 30 further comprises a side portion 36 and a front portion 38. The side portion 36 is for encompassing a perimeter edge 42 of the transparent cover member 40. The front portion 38 is coupled to the side portion 36. The front portion 38 abuts a front edge of the transparent cover member 40 for assisting in selectively coupling the transparent cover member 40 to the support assembly 20.

In a further embodiment a first one 52 of the pair of magnetic coupling members 50 is operationally coupled to the transparent cover member 40 and a second one 54 of the pair of magnetic coupling members 50 is operationally coupled to the backing member 22. Thus the transparent cover member 40 is selectively securable to the backing member 22.

In another embodiment a first one 52 of the pair of magnetic coupling members 50 is operationally coupled to the frame assembly 30 and a second one 54 of the pair of magnetic coupling members 50 is operationally coupled to the backing member 22. Thus the frame assembly 30 is selectively securable to the backing member 22.

In even still a further embodiment the backing member 22 has a groove 26 extending along a back edge providing a space between the frame assembly 30 an the vertical support surface 2 when the frame assembly 30 is coupled to the backing member 22.

In an illustrative optional variation 60 of the display system, such as that shown illustratively in FIGS. 6 through 9 of the drawings, includes an outside perimeter frame element 62 that extends along the outer perimeter of the system 60. The outside perimeter frame element 62 may include a back portion 64 which extends in a back plane of the system 60 and a side portion 66 which extends about the back portion 64 and extends forwardly, preferably in a substantially perpendicular orientation to the back portion 64 of the frame element 62. The outside perimeter frame element 62 is designed to allow multiple stacking of document displaying systems 60.

Figure 8:
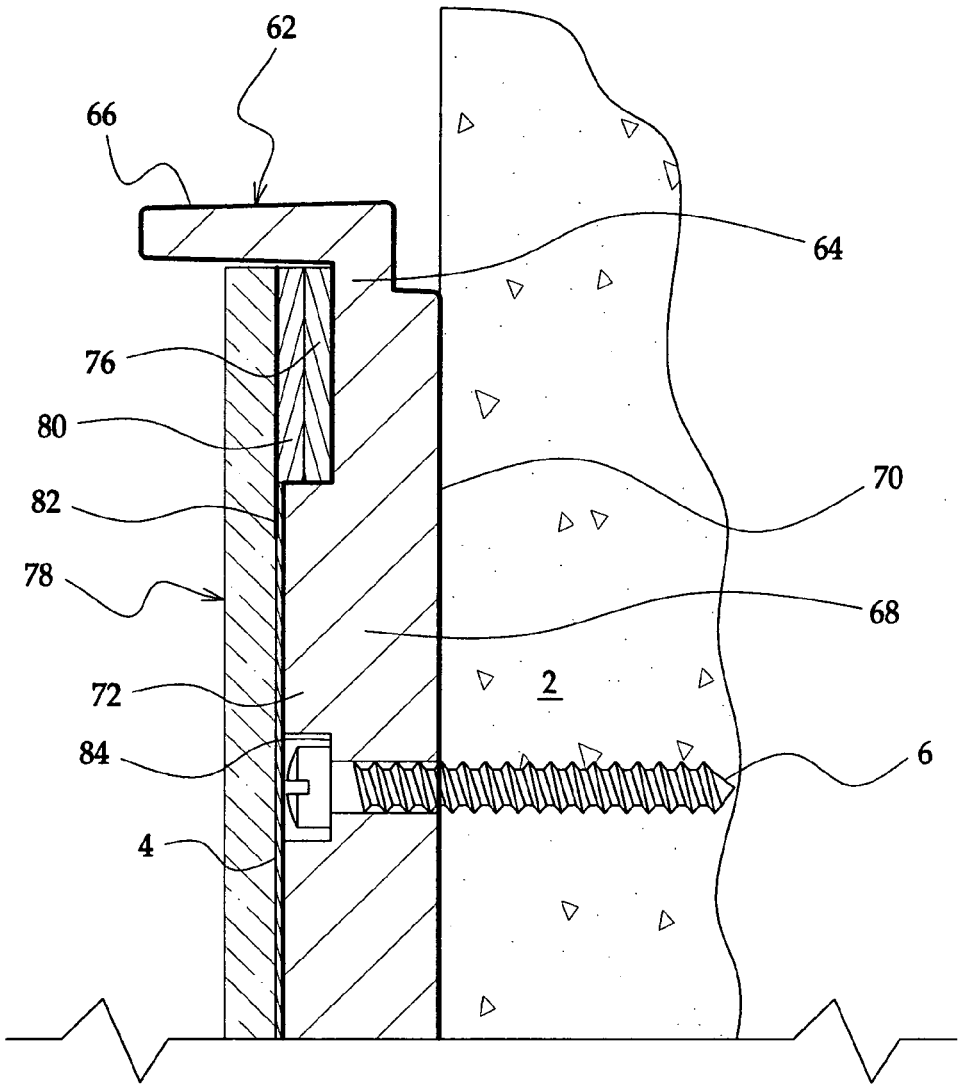
FIG. 8 is a schematic cross-sectional view of a version of the variation of FIG. 6 with several elements consolidated into a single piece.
Figure 9:
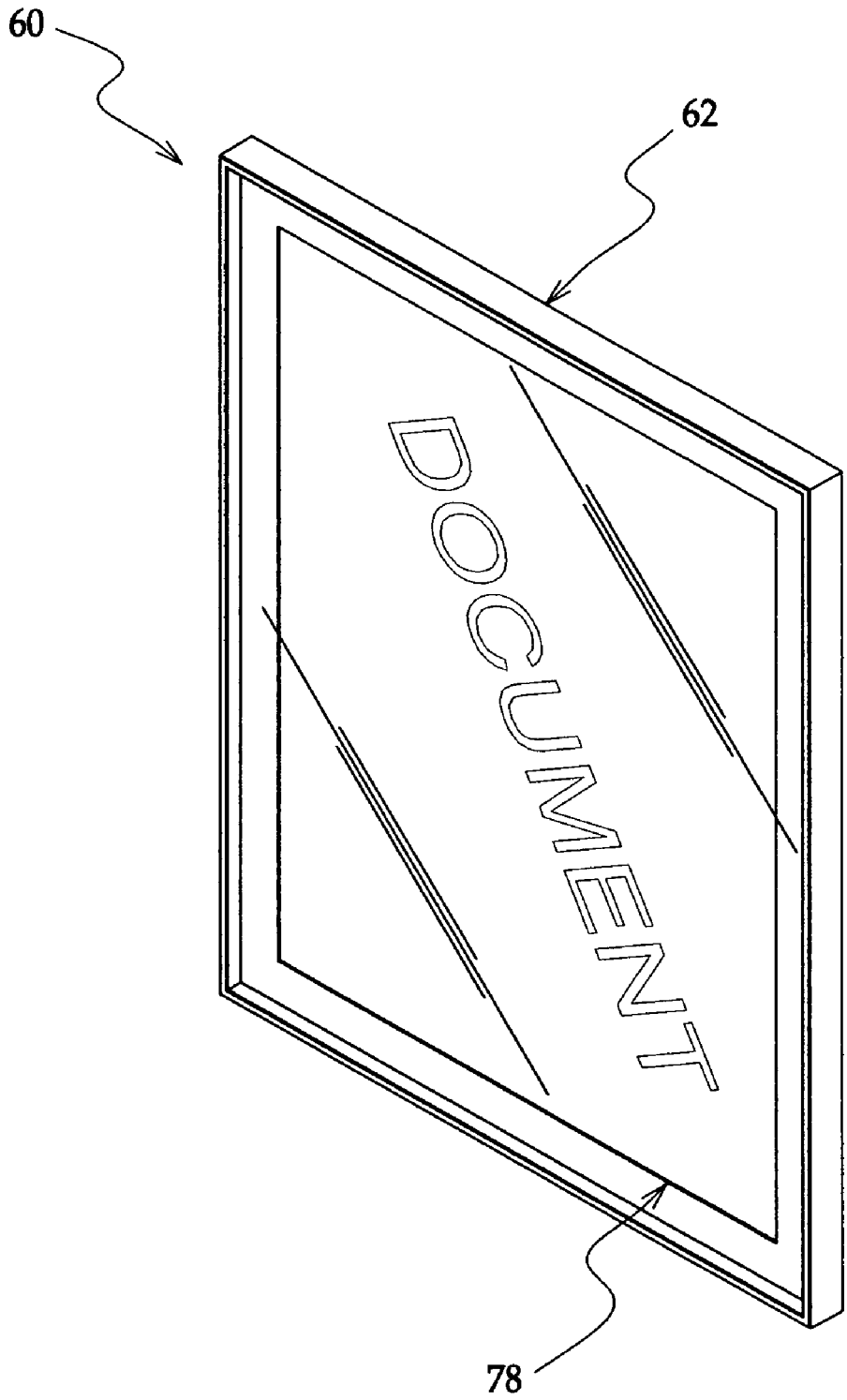
FIG. 9 is a schematic perspective view of the variation shown in FIG. 6 shown in an assembled condition.

The back portion 64 of the frame element 62 may define a void in which an intermediate filler element 68 is located, and the intermediate filler element 68 may be a separate element from the perimeter frame element 62 (such as that shown in FIG. 7), or may be permanently united to the frame element 62 (such as that shown in FIG. 8).

A rear spacing element 70 is located rearwardly of the intermediate filler element 68, and extends outwardly to the frame element 62. In some embodiments of the system 60, the perimeter edge of the rear spacing element 70 does not extend to the outer surface of the side portion of the frame element 62, thereby creating an indented groove to form a reveal or painter's edge behind the frame element 62. The recessed groove of the rear spacing element 70 also allows for multiple stacking of document displaying systems 60. The rear spacing element 70 may also be formed as an element separate from the frame element 62 (FIG. 7), or may be permanently united to the frame element 62 (FIG. 8).

A document backing element 72 is positioned forwardly of the intermediate filler element 68, and extends forwardly of the back portion 64 of the frame element 62 to thereby form a perimeter channel 74 between the document backing element 72 and the side portion 66 of the frame element 62, in front of the back portion 64 of the frame element 62. A document 4 is positionable on a forward surface of the document backing element 72. The document backing element 72 may be formed as a part separate from the perimeter frame element 62 (FIG. 7), or may be permanently united to the frame element and other elements of the system 60 (FIG. 8).

A first magnet 76 is positioned in the perimeter channel 74 and extends along at least a portion of the perimeter channel 74, and in some embodiments extends substantially continuously along the channel. A forward surface of the first magnet 76 is indented or depressed with respect to the forward surface of the document backing element 72.

The system 60 also includes a lens element 78 that is preferably substantially transparent and is positioned in front of the document backing element 72 and the back portion 64 of the frame element 62, and extends over these elements. The lens element 78 holds the document sheet 4 against the document backing element 72. The lens element 78 may have a shiny finish or a matte finish, which reduces noticeable fingerprints and provides a clear viewing window to the document sheet 4. The lens element 78 is preferably substantially coextensive with the space between the side portions of the frame element 62 (FIG. 8). The lens element 78 provides a rigid surface to rest the document sheet 4 against prior to the lens element 78 being positioned inside of the frame element 62.

A second magnet 80 is mounted on a rearward side of the lens element 78 (FIG. 7) for magnetically and releasably attaching to the first magnet 76 when the magnets 76, 80 are brought into proximity to each other as the lens element 78 is moved into the frame element 62 (FIG. 8). The second magnet 80 may extend along at least a portion of the perimeter of the lens element 78, and in some embodiments extends substantially continuously along the perimeter of the lens element 78. When the lens element 78 is positioned in the frame element 62, the second magnet 80 which protrudes from the rearward side of the lens element is inserted into a portion of the perimeter channel 74 that is not occupied by the first magnet 76 so that the first and second magnet may substantially occupy the channel. Thus, the thickness of the first magnet 76 and thickness of the second magnet 80 may substantially equal the depth of the channel below or behind the forward surface of the document backing element 72 (FIG. 8). Further, the protrusion of the second magnet from the rearward side of the lens element 78 may function to position the document 4 with respect to the lens element 78 prior to assembly with the remainder of the system 60. The lens element 78, when made of a plastic material, can also temporarily create a static adhesion with the document sheet 4 prior to lens element 78 being coupled to the remainder of the system 60. The magnet-to-magnet bond is relatively strong in character and resists undesired separation of the lens element 78 from the remainder of the system 60.

Optionally, the lens element 78 may have a relatively opaque perimeter border 82 of the lens element 78 to shield the second magnet 80 (and the first magnet 76) from view when the system 60 is assembled. The border 82 may extend beyond the extent of the second magnet 80 to conceal the edges of the document 4. The opaque border 82 may be any opaque color.

As in the earlier described embodiment, the outside perimeter frame element 62 peripherally encompasses the transparent lens element 78, and aids the alignment of the lens element 78 with the frame element 62, and the alignment of the second magnet 80 and the first magnet 76. The outside perimeter frame element 62 thus conceals and protects the edge of the lens element 78. The arrangement of the elements of the system thus permits removal of the lens element 78 (and the document 4) from the front of the system 60, so that the system may be fixedly and relatively permanently attached to a wall surface.

The substantially coextensive relationship between the lens element 78 and the inner perimeter of the frame element 62 resists unauthorized or casual removal of the document from the system, as a suction cup or other suction generating device is required to engage the forward side of the lens element 78 and pull the lens element 78 outwardly from the cavity formed by the side portions 66 of the frame element 62.

One or more recessed mounting apertures 84 may be located in the system 60, and may penetrate the intermediate filler element 68, the rear spacing element 70, and the document backing element 72. The recessed mounting apertures 84 allow mounting hardware 6 to completely remain below the flat surface of the document backing element 72 to permit the document sheet 4 and the transparent lens element 78 to be unhindered by the hardware 6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A document displaying system comprising:

a perimeter frame element defining a perimeter, the perimeter frame element including a back portion extending along a perimeter of the perimeter frame element and lying in a back plane, and a side portion extending along the perimeter of the perimeter frame element and extending substantially perpendicularly to the back plane;

an intermediate element extending across the back portion of the perimeter frame element, the intermediate element having a perimeter edge, a channel being formed between the perimeter edge of the intermediate element and the side portion of the perimeter frame element;

a cover element removably inserted in the perimeter frame element, the cover element being positioned within the side portion of the perimeter frame element, at least a portion of the cover element being transparent to permit viewing of a document when the document is positioned between the intermediate element and the cover element;

a first magnetic element mounted on a back side of the cover element; and a second magnetic element mounted in said channel for releasably attracting the first magnetic element.

2. The document displaying system of claim 1 wherein the first magnetic element is positioned in the channel when the first and second magnetic elements are magnetically coupled together.

3. The document displaying system of claim 1 wherein the side portion of the perimeter frame element has an inner surface, and the cover element has an outer edge defining a perimeter of the cover element, and wherein the perimeter of the cover element extends to the inner surface of the perimeter frame element such that the outer edge of the cover element is closely adjacent to the inner surface of the perimeter frame element.

4. The document displaying system of claim 1 additionally comprising a backing element coupled to the perimeter frame element.

5. The document displaying system of claim 1 wherein the cover element has a forward surface, the forward surface of the cover element being unobstructed from movement out of the perimeter frame element.

6. The document displaying system of claim 1 wherein the side portion of the perimeter frame element extends beyond a forward surface of the cover element.

7. The document displaying system of claim 1 wherein the perimeter frame element has an outer perimeter surface and a rear surface, a groove extending along at least a portion of the perimeter frame element between the outer perimeter surface and the rear surface.

8. The document displaying system of claim 1 wherein the cover element has a forward surface, and wherein each of the first magnetic element and the second magnetic element extends parallel to the forward surface of the cover element.

9. The document displaying system of claim 1 wherein each of the first and second magnetic elements comprise magnets.

* * * * *